US005484294A

United States Patent [19]

Sobhani

[11] Patent Number: 5,484,294

[45] Date of Patent: Jan. 16, 1996

[54] BRUSHLESS ROTARY CONNECTOR

[75] Inventor: Mohi Sobhani, Encino, Calif.

[73] Assignee: Hughes Aircraft Company, Los Angeles, Calif.

[21] Appl. No.: 335,235

[22] Filed: Nov. 7, 1994

[51] Int. Cl.[6] ..... H01R 39/10; H01R 23/66

[52] U.S. Cl. ..... 439/21; 439/67

[58] Field of Search ..... 439/13, 18, 20–22, 439/27, 67, 77, 492

[56] References Cited

U.S. PATENT DOCUMENTS 3,318,785 5/1967 Armstrong et al. ..... 439/20

5,195,898 3/1993 Mary ..... 439/77

5,409,403 4/1995 Falossi et al. ..... 439/21

*Primary Examiner*—Gary F. Paumen

*Attorney, Agent, or Firm*—M. E. Lachman; M. W. Sales; W. K. Denson-Low

[57] ABSTRACT

A brushless rotary connector comprising first and second housings that are rotatable relative to each other and respectively house first and second flat flexible printed circuits having conductive contacts disposed adjacent each other that are rotatable relative to each other. Electrical cables are coupled to the respective conductive contacts. The conductive contacts rotate relative to each other while maintaining contact with each other as the housings rotate, thus permitting electrical signals to be coupled through the connector.

15 Claims, 3 Drawing Sheets

FIG. 2.
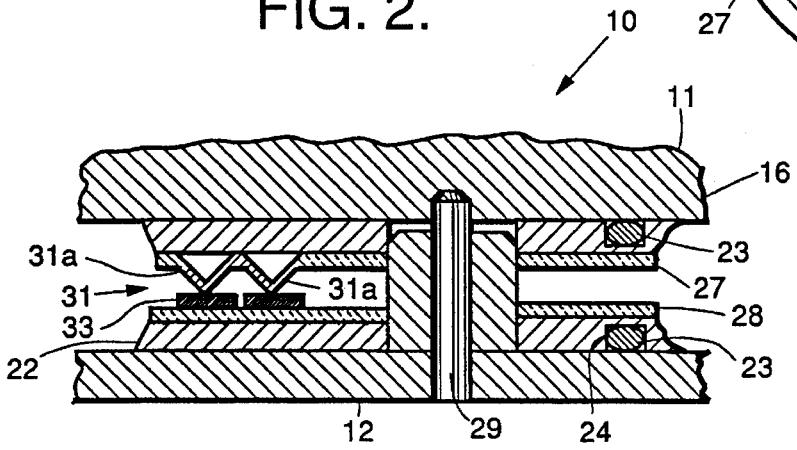
FIG. 3.
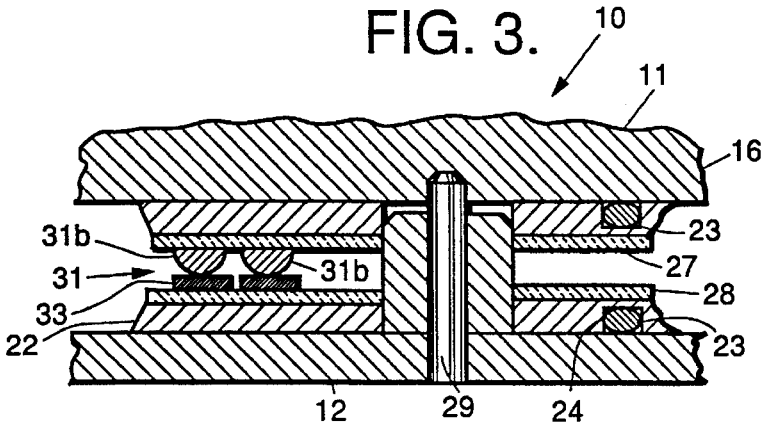
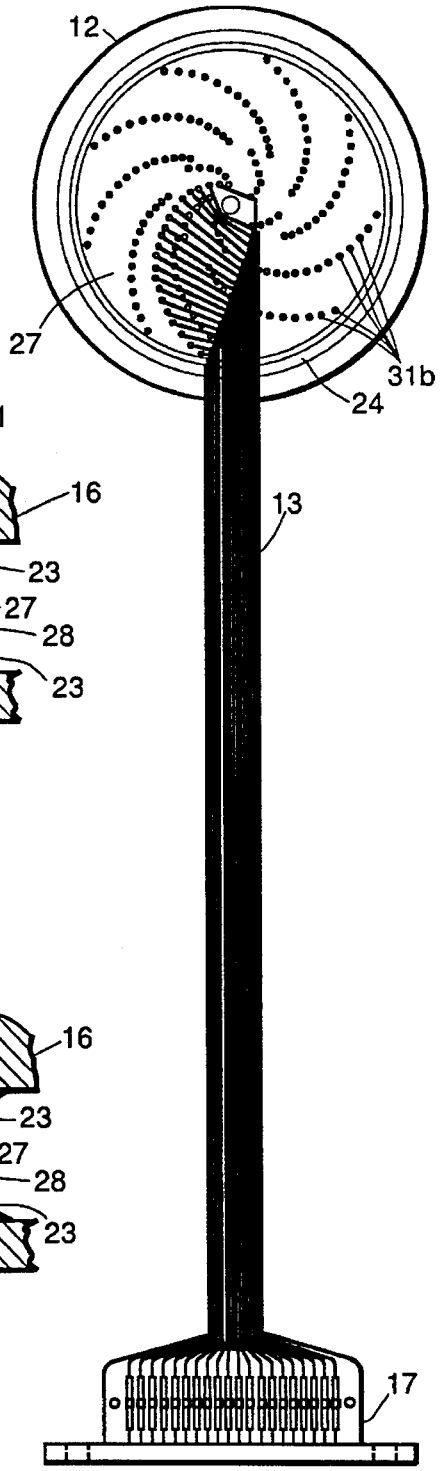
FIG. 5.

BRUSHLESS ROTARY CONNECTOR

BACKGROUND

The present invention relates to rotary connectors or slip rings, and more particularly, to a brushless rotary connector or slip ring employing flexprint circuits.

Current methods of transferring signals and power between stationary and moving parts are achieved by three major methods including slip-rings, commutator brushes, and cable wrap assemblies. Each has its problems. The major problems are cost, complexity, weight, and reliability.

A slip ring is designed and fabricated to transfer signals and power from a stationary housing to a revolving object such as a gimbal, or a commutator, or the like. Slip ring technology is about 40 years old and has proven to work well. However, conventional slip rings are labor intensive, are very expensive, and have reliability problems, such as when they experience vibration. Conventional slip rings are available from such manufacturers as Litton and Aeroflex, for example. Conventional slip rings typically employ brushes, springs and ball bearings, which adds to their complexity and cost. At high power levels, the brushes can bum during operation. A typical 24 conductor contact slip-ring connector has 128 parts, including rings, brushes, bearing, wires and housings. Also there is a limited amount of power that is typically transferred by conventional slip ring assemblies.

Conventional commutator brushes are prone to bum-out and, are very heavy and relatively expensive. The majority of component failures of commutator brushes are due to the weaknesses in the brushes. Conventional cable wrap assemblies provide for limited distance and rotation. They are relatively heavy and large devices. They are also relatively expensive due to labor intensive fabrication operations. They also have a relatively short life span due to wear and tear of the cable. They experience a relatively high failure rate due to mishandling and alignment problems.

Therefore, it is an objective of the present invention to provide for an improved brushless rotary connector or slip ring employing flexprint circuits.

SUMMARY OF THE INVENTION

In order to meet the above and other objectives, the present invention is a brushless rotary connector or slip ring. The brushless rotary connector comprises dimpled or bumped flexprint circuits, two plates that respectively secure the flexprint circuits, two housings that respectively house the plates and flexprint circuits, and in a preferred embodiment, two O-rings that interface between the respective housings and plates.

More specifically, the brushless rotary connector comprises a first housing, having a first relatively flat flexible printed circuit disposed therein. The first flexible printed circuit has a conductive contact disposed on a surface thereof. A first flexible cable is coupled to the conductive contact of the first flexible printed circuit for coupling electrical signals thereto and therefrom. A second housing comprises a second relatively flat flexible printed circuit that has at least a portion of a conductive ring disposed on a surface thereof. The second flexible printed circuit is disposed such that the conductive ring contacts the conductive contact of the first flexible printed circuit. A second flexible cable is coupled to the conductive ring of the second flexible printed circuit for coupling the electrical signals thereto and therefrom. A collar or other means for securing the first and second housings together is provided so that the conductive contact and ring properly contact each other.

In operation, the first and second housings and first and second printed circuits are free to rotate relative to each other. As the housings rotate, the conductive contact and ring of the flexprint circuits maintain electrical contact with each other to couple the electrical signals through the connector. The brushless rotary connector was designed to transfer video signals and power from a stationary platform to a moving object without interrupting or limiting the revolution of the moving object at high or low speed. The connector of the present invention achieves this goal.

The present brushless rotary connector employs no brushes, springs, or ball bearings. All moving electrical components are made using printed wiring technology that is used to produce the flexprint circuits. The brushless rotary connector uses flat slip rings (the flexible printed circuits) that are capable of operation at full military temperature (125° Celsius). The present connector has been tested and is capable of transferring current up to 15 amps. The brushless rotary connector provides for a cost effective alternative to conventional brush-type rotary connectors or slip rings.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 2 shows a cross sectional side view of the brushless rotary connector of FIG. 1 employing bump-type contacts;

FIG. 3 shows a cross sectional side view of the brushless rotary connector of FIG. 1 employing dimple-type contacts;

FIG. 5 shows a complete top view of the brushless rotary connector of FIG. 4.

DETAILED DESCRIPTION

Figure 1:
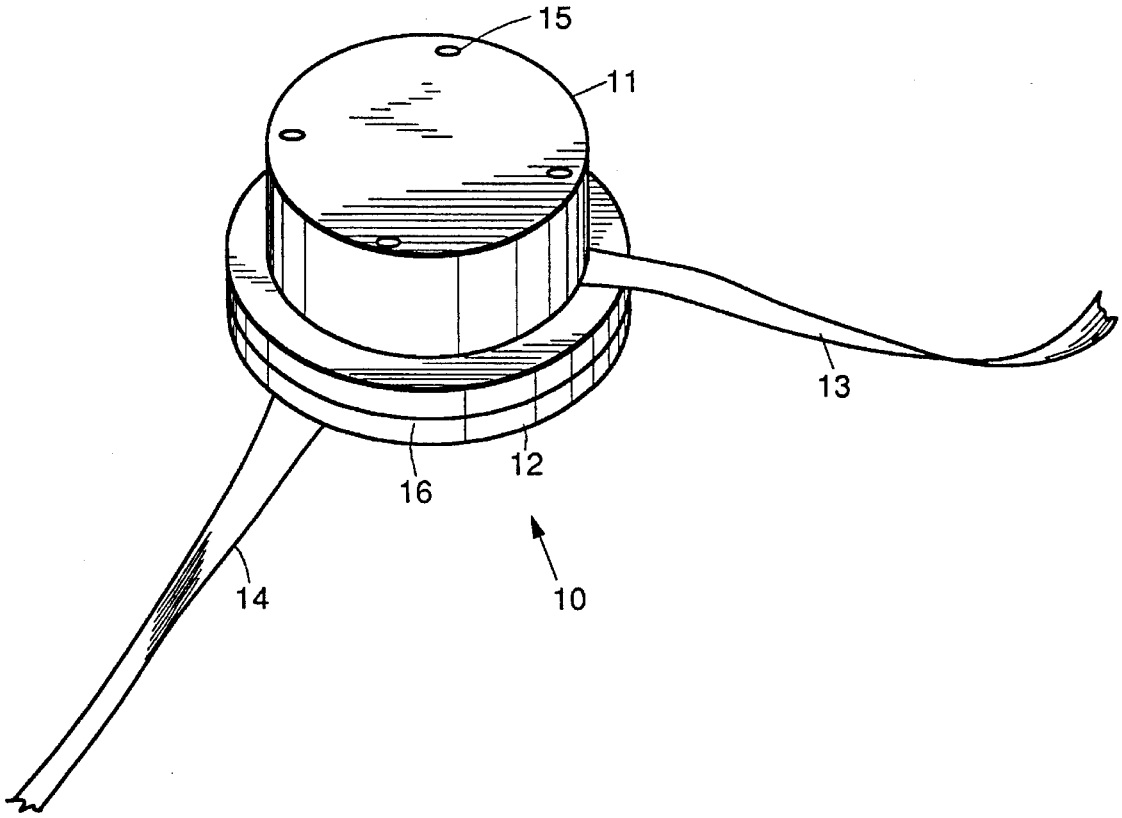
FIG. 1 illustrates a perspective view of an assembled brushless rotary connector in accordance with the principles of the present invention.

Referring to the drawing figures, FIG. 1 illustrates a perspective view of an assembled brushless rotary connector 10, or slip ring 10, in accordance with the principles of the present invention. The brushless rotary connector 10 is comprised of first and second circular housings 11, 12 (top and bottom, respectively, in the drawing figures) that internally house first and second circular flexible printed circuits 27, 28 (shown in FIGS. 2 and 3). A collar 16, such as a brass ring, for example, is used to secure the first and second circular housings 11, 12 together. The first (top) housing 11 has a top-hat shaped cross section that has a lip (not shown) and the collar 16 slides along the outer sidewall of the first housing 11 until it abuts the lip. The collar is then secured to the second (bottom) housing 12 by means of screws, for example. The first and second housings are free to rotate relative to each other, which is achieved using the first and second flexible printed circuits 27, 28, which slide relative to each other, as will be explained in more detail below.

First and second flexible cables 13, 14 are internally coupled to the first and second flexible printed circuits 27, 28, respectively, and extend outside the respective first and second circular housings 11, 12 by way of openings (not shown). The first and second circular housings 11, 12 are rotatable relative to each other. Typically, one of the housings 11 is fixed while the other of the housings 12 is secured to a component that rotates. The components housed within the respective first and second circular housings 11, 12 are secured together in a routine manner by means of a plurality of screws and threaded holes, for example, and those for securing the components disposed within the first housing 11 are generally designated as 15.

FIGS. 2 and 3 show cross sectional side views of two embodiments of the brushless rotary connector 10 of FIG. 1. The embodiment of FIG. 2 employs dimples 31*a* as contacts 31 while the embodiment of FIG. 3 employs bumps 31*b* as the contacts 31. First and second circular metal plates 21, 22 are respectively disposed in recesses (not shown) in the first and second housings 11, 12. The first and second plates 21, 22 have O-rings 23 located in circular grooves 24 that respectively contact adjacent surfaces of the first and second housings 11, 12. The first and second plates 21, 22 have their adjacent surfaces disposed 0.010 inches to 0.020 inches apart to properly space the flexible printed circuits 27, 28 using a plurality of adjustable screws (not shown) located in the respective first and second housings 11, 12. The first and second plates 21, 22 are used to stiffen the first and second flexprint circuits 27, 28 so that they do not deform during operation. The plates 21, 22 may also be made of materials other than metal, but their purpose is to provide a strong substrate for the flexprint circuits 27, 28.

The first and second plates 21, 22 are bonded by means of epoxy or glue, for example, or otherwise secured to the first and second flexprint circuits 27, 28, in a manner such that the metallized contacts 31 face each other. The first flexprint circuit 27 is fabricated to have metallized contacts 31 comprising bumps 31*b* (FIG. 3) or dimples 31*a* (FIG. 2) disposed on one surface thereof. The second flexprint circuit 28 is fabricated to have one or more metallized rings 33 (or portions thereof) disposed on one surface thereof. The respective metallized surfaces of the flexprint circuits 27, 28 with the contacts 31 and rings 33 disposed thereon are disposed in contact with each other as is shown in FIGS. 2 and 3. An alignment pin 29 is provided to align the first and second flexprint circuits 27, 28 so that the contacts 31, 33 properly contact each other. The alignment pin 29 is generally located in the center of the flexprint circuits 27, 28, as is shown more clearly in FIG. 4, for example. As the two housings 11, 12 rotate with respect to each other the metallized contacts 31, 33 of the two flexprint circuits 27, 28 maintain electrical contact with each other.

Figure 4:
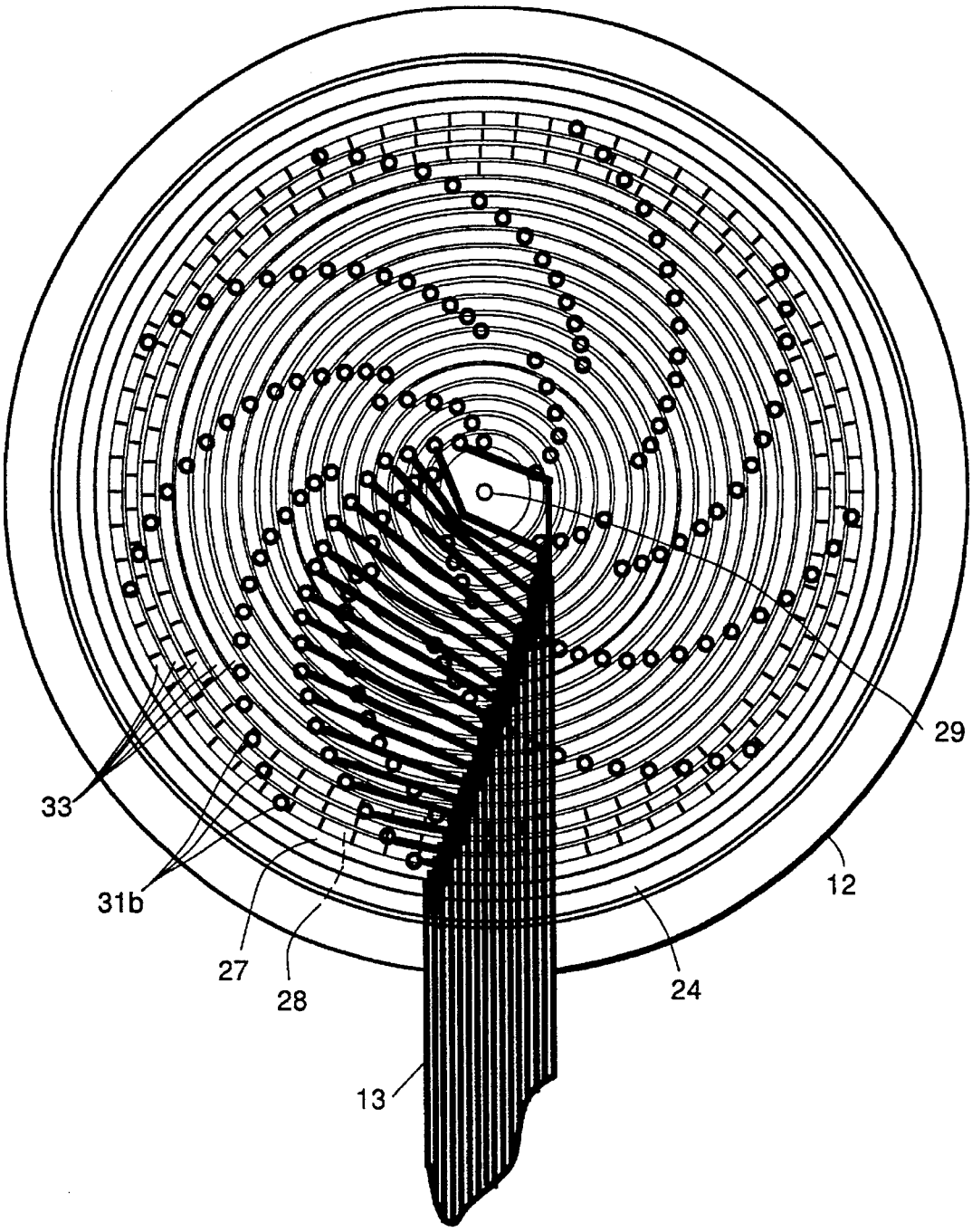
FIG. 4 shows an enlarged top view of the internal portion of the brushless rotary connector of FIG. 3.

FIG. 4 shows an enlarged top view of the internal portion of the brushless rotary connector 10 illustrating details of the flexprint circuits 27, 28, and FIG. 5 shows a complete top view of the brushless rotary connector 10 shown in FIG. 4. Referring to FIG. 4, the first flexprint circuit 27 containing the bumps 31*b* is disposed above the second flexprint circuit 28 containing the rings 33. The location of the O-ring groove 24 is shown in the second (lower) housing 12 along with the location of the alignment pin 29. The routing of conductors of the cable 13 to the bumps 31*b* is shown for clarity. FIG. 5 shows that the cable 13 is ultimately connected to a connector 17 which mates with a source of electrical signals, such as video or power signals, for example that are to be routed through the brushless rotary connector 10.

The present invention may be used in many applications including night vision systems, radar system, helicopters, aircraft and spacecraft, for example, such as for rotating gimbals, and rotating antennas, and the like. The brushless rotary connector provides a next generation device for transferring signals and power between two associated parts where one moves and one is stationary.

The use of printed circuit technology simplifies the mating of conductor contacts 31, and rings 33. A nine conductor 10 and a 24 conductor connector 10 have been built and tested to date. One test connector 10 has completed 12,000 rotational hours of test (7,200,000 cycles at a cycle rate of 10 cycles per minutes) with no failures. Power, DC/AC current levels up to two amps, and RS-170 video signals were passed through the conductor contacts 31, 33 during the tests with no degradation.

While a conventional 24 conductor contact slip-ring connector has 128 parts, a 24 conductor contact rotary connector 10 includes only 9 parts. Of these nine, only two require precision machining. The cost of the rotary connector 10 in production is expected to be one-third that of a comparable conventional slip-ting assembly.

Thus there has been described a new and improved brushless rotary connector or slip ring employing flexprint circuits. It is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A brushless rotary connector comprising:

a first housing;

a first relatively flat flexible printed circuit disposed in the first housing and having a conductive contact disposed on a surface thereof;

a first flexible cable coupled to the conductive contact of the first flexible printed circuit for coupling electrical signals thereto and therefrom;

a second housing;

a second relatively flat flexible printed circuit disposed in the second housing and having at least a portion of a conductive ring disposed on a surface thereof that contacts the conductive contact of the first flexible printed circuit;

a second flexible cable coupled to the conductive ring of the second flexible printed circuit for coupling the electrical signals thereto and therefrom; and means for securing the first and second housings together so that the conductive contact and ring contact each other;

wherein the first and second housings and first and second printed circuits are free to rotate relative to each other, and wherein as the housings rotate, the conductive contact and ring of the flexprint circuits maintain electrical contact with each other to couple the electrical signals through the connector.

2. The connector of claim 1 further comprising:

a first plate disposed in the first housing that comprises an O-ring that contacts an adjacent surface of the first housing, and wherein the first flexible printed circuit is secured to the first plate; and a second plate disposed in the second housing that comprises an O-ring that contacts an adjacent surface of the second housing, and wherein the second flexible printed circuit is secured to the second plate.

3. The connector of claim 1 wherein the contacts comprise dimples.

4. The connector of claim 1 wherein the contacts comprise bumps.

5. The connector of claim 2 wherein the first and second plates have their adjacent surfaces disposed a predetermined distance apart to allow for rotation of the flexible printed circuits.

6. The connector of claim 2 wherein the first and second plates are bonded by means of epoxy or glue.

7. The connector of claim 2 wherein the first and second plates are bonded by means of glue.

8. The connector of claim 1 which further comprises an alignment pin for aligning the first and second flexprint circuits so that the contacts properly contact each other.

9. A brushless rotary connector comprising:

a first housing;

a first plate disposed in the first housing that comprises an O-ring that contacts an adjacent surface of the first housing;

a first relatively flat flexible printed circuit secured at a first surface to the first plate and having a conductive contact disposed on a second surface thereof;

a first flexible cable coupled to the conductive contact of the first flexible printed circuit for coupling an electrical signal thereto;

a second housing;

a second plate disposed in the second housing that comprises an O-ring that contacts an adjacent surface of the second housing;

a second relatively flat flexible printed circuit secured at one surface to the second plate and having at least a portion of a conductive ring disposed on a second surface thereof that contacts the conductive contact of the first flexible printed circuit;

a second flexible cable coupled to the conductive ring of the second flexible printed circuit for coupling an electrical signal therefrom; and a collar for securing the first and second housings together so that the conductive contact and ring contact each other;

wherein the first and second housings are free to rotate relative to each other, and wherein as the housings rotate, the conductive contact and ring of the flexprint circuits maintain electrical contact with each other to couple the electrical signal through the connector.

10. The connector of claim 9 wherein the contacts comprise dimples.

11. The connector of claim 9 wherein the contacts comprise bumps.

12. The connector of claim 9 wherein the first and second plates have their adjacent surfaces disposed a predetermined distance apart to allow for rotation of the flexible printed circuits.

13. The connector of claim 9 wherein the first and second plates are bonded by means of epoxy or glue.

14. The connector of claim 9 wherein the first and second plates are bonded by means of glue.

15. The connector of claim 9 which further comprises an alignment pin for aligning the first and second flexprint circuits so that the contacts properly contact each other.

* * * * *